US006160984A

United States Patent [19]

Koike

[11] Patent Number: 6,160,984

[45] Date of Patent: Dec. 12, 2000

[54] TONER FILTER ARRANGEMENT HAVING MOVABLE MAGNETIC CORES

[75] Inventor: Michiro Koike, Kawasaki, Japan

[73] Assignee: Canon Kabushiki Kaisha, Tokyo, Japan

[21] Appl. No.: 08/657,430

[22] Filed: Jun. 3, 1996

Related U.S. Application Data

[63] Continuation of application No. 08/188,838, Jan. 31, 1994, abandoned.

[30] Foreign Application Priority Data

Feb. 1, 1993 [JP] Japan ..... 5-034008

[51] Int. Cl.[7] ..... G03G 21/10

[52] U.S. Cl. ..... 399/359

[58] Field of Search ..... 399/358, 359

[56] References Cited

U.S. PATENT DOCUMENTS

| | | | |
|---|---|---|---|
| 4,054,381 | 10/1977 | Bernard | 355/298 X |
| 4,267,245 | 5/1981 | Wada | 118/652 X |
| 4,389,968 | 6/1983 | Satomura | 118/652 |
| 4,595,277 | 6/1986 | Maczuszenko et al. | 355/245 X |
| 4,624,559 | 11/1986 | Heneda et al. | 355/253 |
| 4,972,231 | 11/1990 | Bares | 355/251 |
| 5,260,760 | 11/1993 | Takemura et al. | 355/245 X |
| 5,455,666 | 10/1995 | Saito et al. | 355/298 |
| 5,486,905 | 1/1996 | Takeda et al. | 355/215 |

FOREIGN PATENT DOCUMENTS

| | | |
|---|---|---|
| 56-74284 | 6/1981 | Japan . |
| 56-165180 | 12/1981 | Japan . |
| 60-257478 | 12/1985 | Japan . |
| 61-46572 | 3/1986 | Japan . |
| 2-11913 | 3/1990 | Japan . |
| 2160271 | 6/1990 | Japan . |
| 4-367873 | 12/1992 | Japan . |
| 5-289503 | 11/1993 | Japan . |

OTHER PUBLICATIONS

Patent Abstract of Japan, vol. 14, No. 415, (p. 1102) Sep. 7, 1990.

Patent Abstract of Japan, vol. 10, No. 135, (p. 457) May 20, 1980.

*Primary Examiner*—William J. Royer
*Attorney, Agent, or Firm*—Fitzpatrick, Cella, Harper & Scinto

[57] ABSTRACT

A developing agent filtering apparatus includes a filtering arrangement for filtering magnetic toner from the mixture of the magnetic toner and foreign matter. The filtering arrangement includes a pair of magnetic field generating members, and a filter for regulating a shifting movement of the foreign matter from one of the pair of magnetic field generating members to the other; and a switch for changing the configuration of a magnetic field generated by the pair of magnetic field generating members. The switch switches a relative position between the pair of magnetic field generating members between a first position where opposite magnetic polarities of the pair of magnetic field generating members are opposed to each other and a second position different from the first position.

19 Claims, 11 Drawing Sheets

TONER FILTER ARRANGEMENT HAVING MOVABLE MAGNETIC CORES

This application is a continuation of application Ser. No. 08/188,838 filed Jan. 31, 1994, now abandoned.

BACKGROUND OF THE INVENTION

1. Field of the Invention

The present invention relates to a developing agent reproducing, i.e. filtering, hereinafter mostly referred to as "filtering", apparatus for filtering a developing agent (developer) from a mixture of developer and foreign matters, and an image forming apparatus using such developing agent reproducing, i.e. filtering apparatus.

2. Related Background Art

In the past, after a developer image was transferred from an image bearing member to a recording material, residual matters remaining on the image bearing member were removed from the image bearing member by a cleaning blade and the like and such residual matters were disposed as the waste matter. From a view-point of the effective usage of resources, various apparatuses for separating the developing agent from the residual matters and apparatuses for reusing such developing agent have been proposed. Among them, various apparatuses wherein the residual matters are dropped onto a mesh filter to separate the developing agent passed through the filter from the other foreign matter not passed through the filter have been proposed since they have the simple construction.

However, when the developing agent is separated from the other foreign matter by using the filter (particularly, mesh filter) to reproduce the developing agent, there arises a problem that the mesh is clogged by the foreign matter such as paper powder included in the residual matter removed from the image bearing member. In particular, when the mesh is made smaller to remove the smaller foreign matter, the mesh is apt to be clogged. Accordingly, the maintenance of the reproducing, i.e. filtering apparatus must be performed frequently, and, thus, it was difficult to put such filtering apparatus to practical use.

In order to solve this problem, there has been proposed an apparatus wherein a magnetic field is generated by a pair of magnets to eject magnetic toner in the residual matter removed from an image bearing member in a direction opposite to the gravity acting direction where a mesh filter is provided between the pair of magnets to regulate the passage of foreign matter such as paper powder flying together with the magnetic toner through the filter.

By this apparatus, the foreign matter consisting of the non-magnetic matters such as the paper powder regulated by the mesh filter are separated from the magnetic toner, and the separated foreign matter are dropped by their own weight to leave the mesh filter, thereby effectively preventing the clogging of the mesh.

However, when the apparatus is in an inoperative condition for a long time, the triboelectric brush of the magnetic toner (including the foreign matters such as the paper powder) is formed between the pair of magnets. Accordingly, the magnetic toner in the form of the triboelectric brush which was not passed through the mesh filter is adhered to the mesh filter, with the result that, even when the apparatus is operated, such magnetic toner is not separated from the mesh filter, thereby causing the clogging of the mesh.

SUMMARY OF THE INVENTION

The present invention intends to eliminate the above-mentioned conventional drawbacks, and has an object to provide a developing agent, i.e. filtering, apparatus, and an image forming apparatus having such developing agent filtering apparatus, which can prevent the clogging of a filter and can lengthen the time period between the maintenances of the apparatus.

Another object of the present invention is to provide a developing agent, i.e. filtering apparatus, and an image forming apparatus having such developing agent filtering apparatus, in which a switching means for switching the configuration of a magnetic field generating by a pair of magnetic field generating members is provided.

The other objects and features of the present invention will be apparent from the following detailed explanation referring to the accompanying drawings.

DETAILED DESCRIPTION OF THE PREFERRED EMBODIMENTS

First of all, a first embodiment of an image forming apparatus having a developing agent filtering apparatus to which the present invention is applied will be explained with reference to the accompanying drawings.

Figure 1:
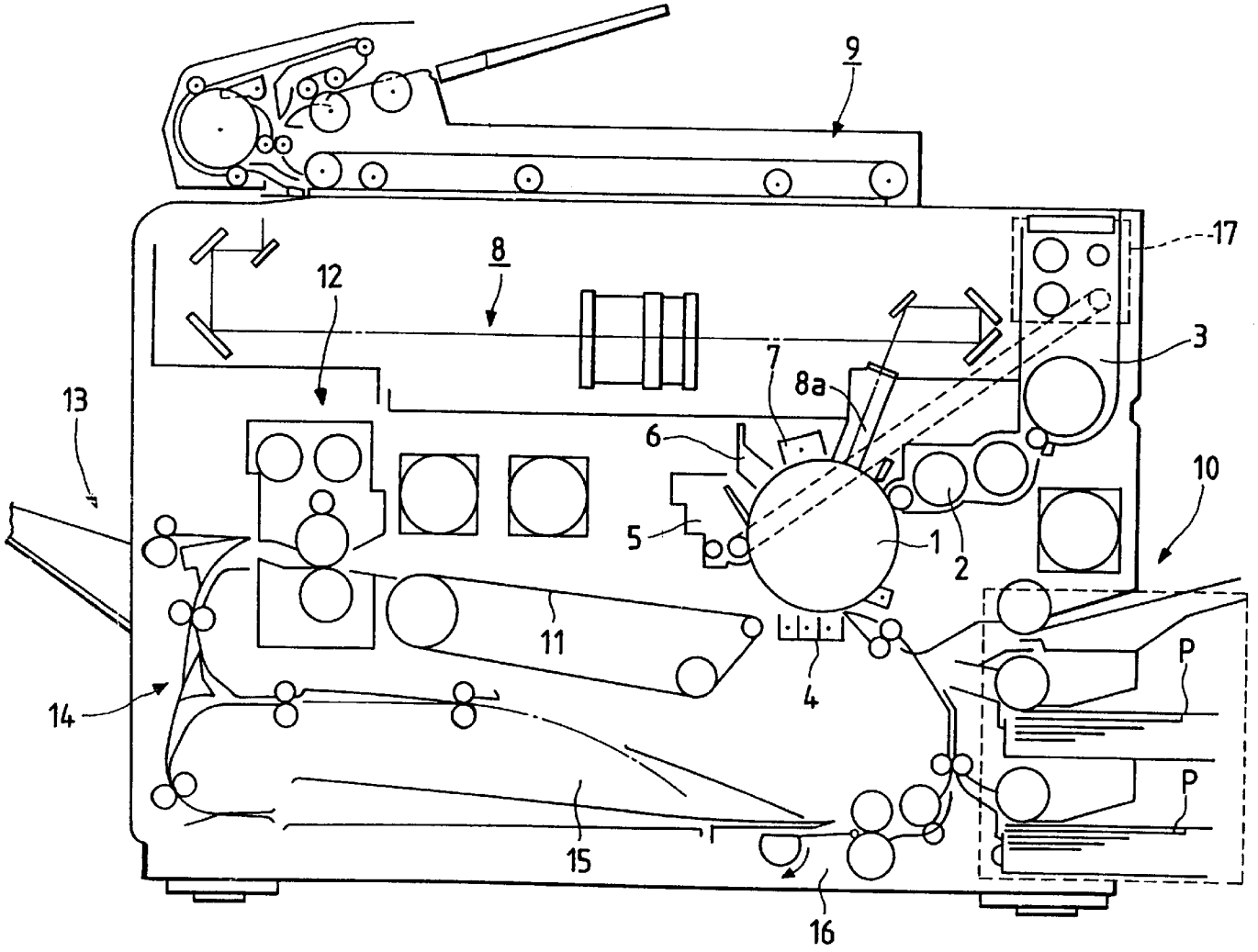
FIG. 1 is a schematic elevational sectional view of an image forming apparatus having a developing agent filtering apparatus according to the present invention.

In FIG. 1 which is a schematic elevational sectional view of the image forming apparatus, the image forming apparatus comprises a photosensitive drum (image bearing member) 1, a developing device 2 for visualizing a latent image formed on the photosensitive drum 1 with developer (developing agent), a hopper portion 3 for supplying the developer (one-component developer including magnetic toner in this embodiment) to the developing device 2, a transfer and separation charger 4 for transferring the visualized toner image on the photosensitive drum 1 onto a sheet (recording material), a cleaning device 5 for removing and collecting the toner and the other foreign matter remaining on the photosensitive drum 1, an electricity removal portion 6 for removing the electricity on the photosensitive drum 1, a first or primary charger 7 for uniformly charging the photosensitive drum 1, an optical reading system 8 for reading image information on an original, and an exposure portion 8*a* for forming the image information on the photosensitive drum 1 as a latent image. Further, there are also provided an original treatment device 9 for directing the original to an image reading portion, a sheet supply portion 10 for supplying a sheet to an image forming portion, a convey means 11, a fixing device 12 for fixing an image (toner image) transferred to the sheet in the image forming portion, a sheet discharge portion 13 to which the sheet on which the image was formed is discharged, a sheet re-supply induction portion 14 for directing or guiding the sheet to be re-supplied in a both-face recording mode or in a multi recording mode, an intermediate tray 15 for temporarily storing the sheet to be re-supplied, and a sheet re-supply portion 16 for supplying the sheet stored on the intermediate tray 15 to the image forming portion again.

Next, the operation of the image forming apparatus will be explained.

When a copy start button (not shown) is depressed, the original in the original treatment device 9 is sent to the image reading portion, where the image information on the original is read by the optical reading system 8. Thereafter, the electricity on the photosensitive drum 1 is removed by the electricity removal portion 6, and then the photosensitive drum 1 is charged by the first charger 7 at a predetermined potential. Then, in the exposure portion 8*a*, the image information is written on the photosensitive drum as the latent image. Then, the latent image formed on the photosensitive drum 1 is visualized by the developing device 2 with the magnetic toner. In this case, when the magnetic toner in the developing device 2 is decreased, the new toner is replenished from the hopper portion 3 to the developing device. At the same time, when the sheet P is sent from the sheet supply portion 10 to the image forming portion, the toner image on the photosensitive drum 1 is transferred onto the sheet P by the transfer and separation charger 4. After the transferring, the sheet is sent, by the convey means 11, to the fixing device 12, where the toner image is fixed to the sheet P. After the fixing, in the single-face copy mode, the sheet is discharged onto the discharge portion 13.

On the other hand, in the both-face recording mode or in the multi recording mode, the sheet is not discharged but is stored on the intermediate tray 15 through the sheet re-supply induction portion 14. When a predetermined number of sheets are stored on the intermediate tray, the sheets are separated and supplied one by one by the sheet re-supply portion 16, and the separated sheet is sent to a transfer station of the image forming portion again. When a next original is sent to the image reading portion by the original treatment device 9, the above-mentioned processes are repeated, and, after the fixing of the toner image, the sheet is discharged onto the discharge portion 13.

The residual matters (such as the developer, paper powder, dust and the like) which were not transferred to the transfer and separation charger 4 during the image forming operation and remain on the photosensitive drum 1 are removed by the cleaning device 5. The removed developer and the other residual matter (referred to as "foreign matters" hereinafter) is sent to a developing agent reproducing apparatus, mostly referred to herein as "filtering apparatus" hereinafter) which will be described later.

Figure 2:
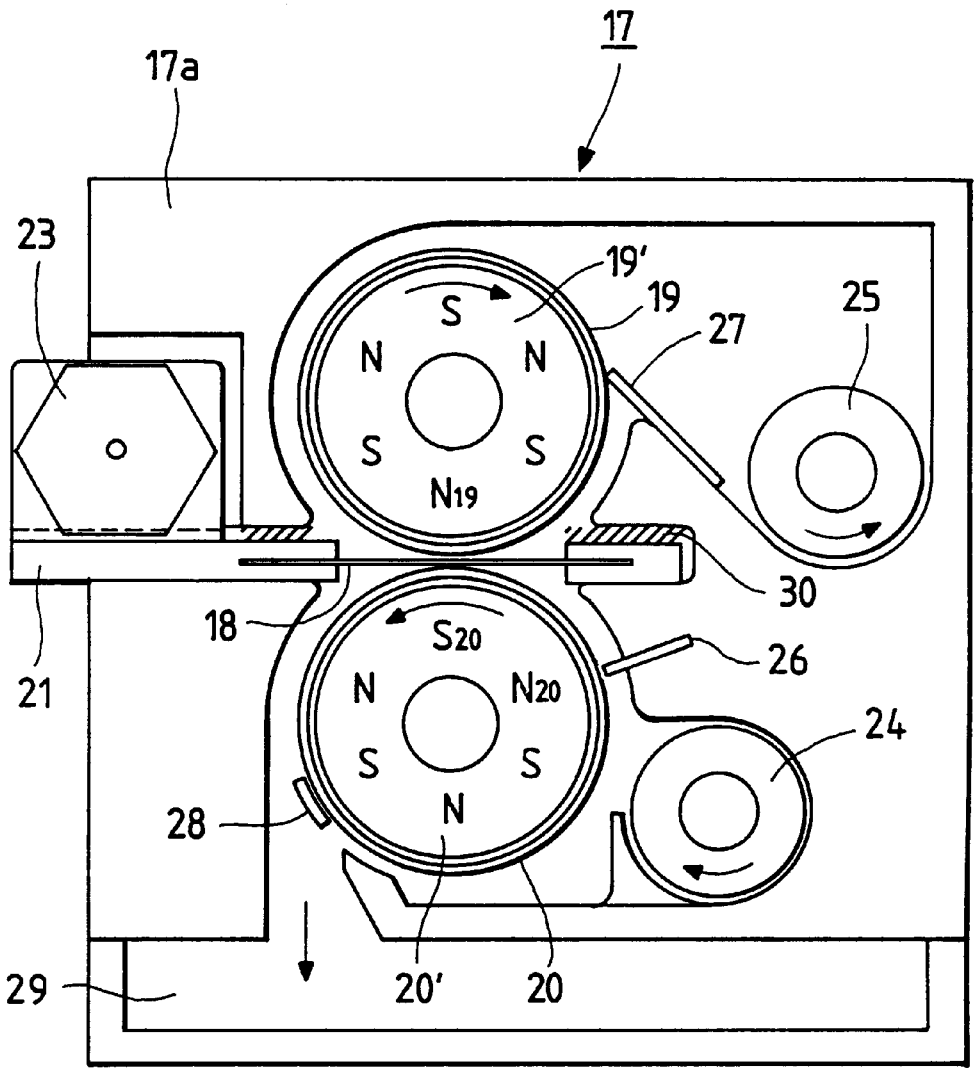
FIG. 2 is a sectional view of a developing agent reproducing apparatus according to a first embodiment of the present invention.
Figure 3:
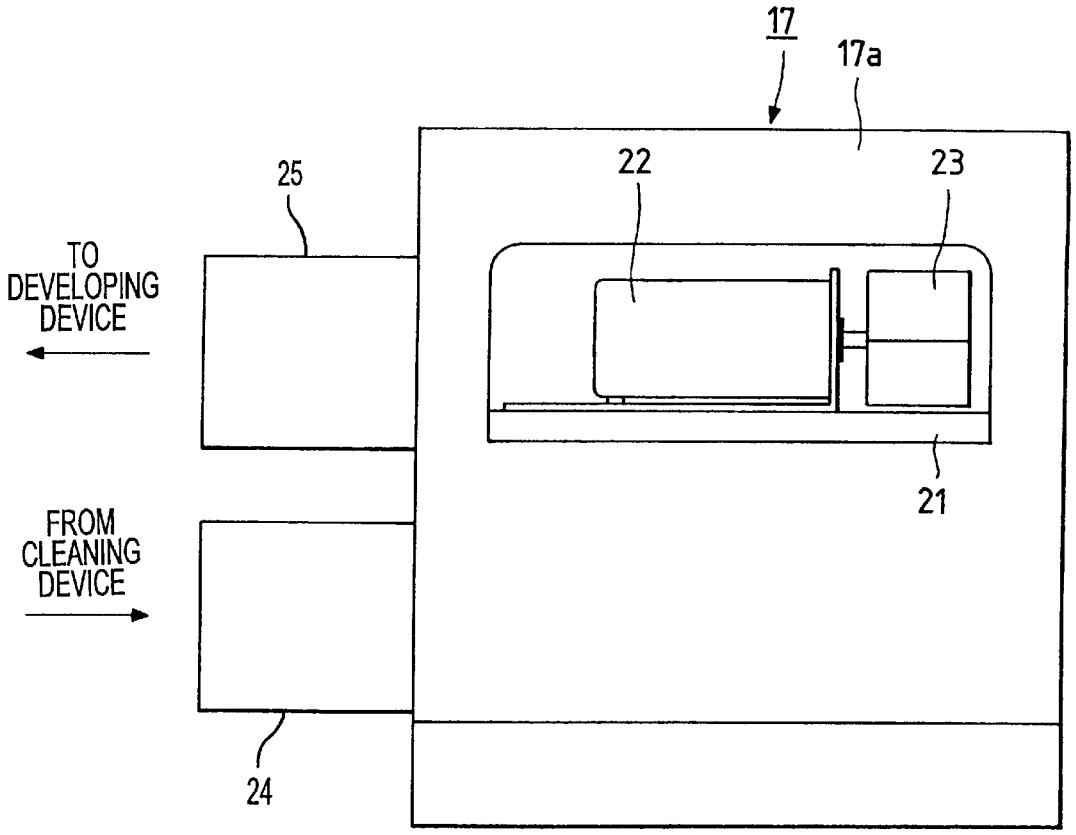
FIG. 3 is a side view of the developing agent filtering apparatus to which the present invention is applied.
Figure 4:
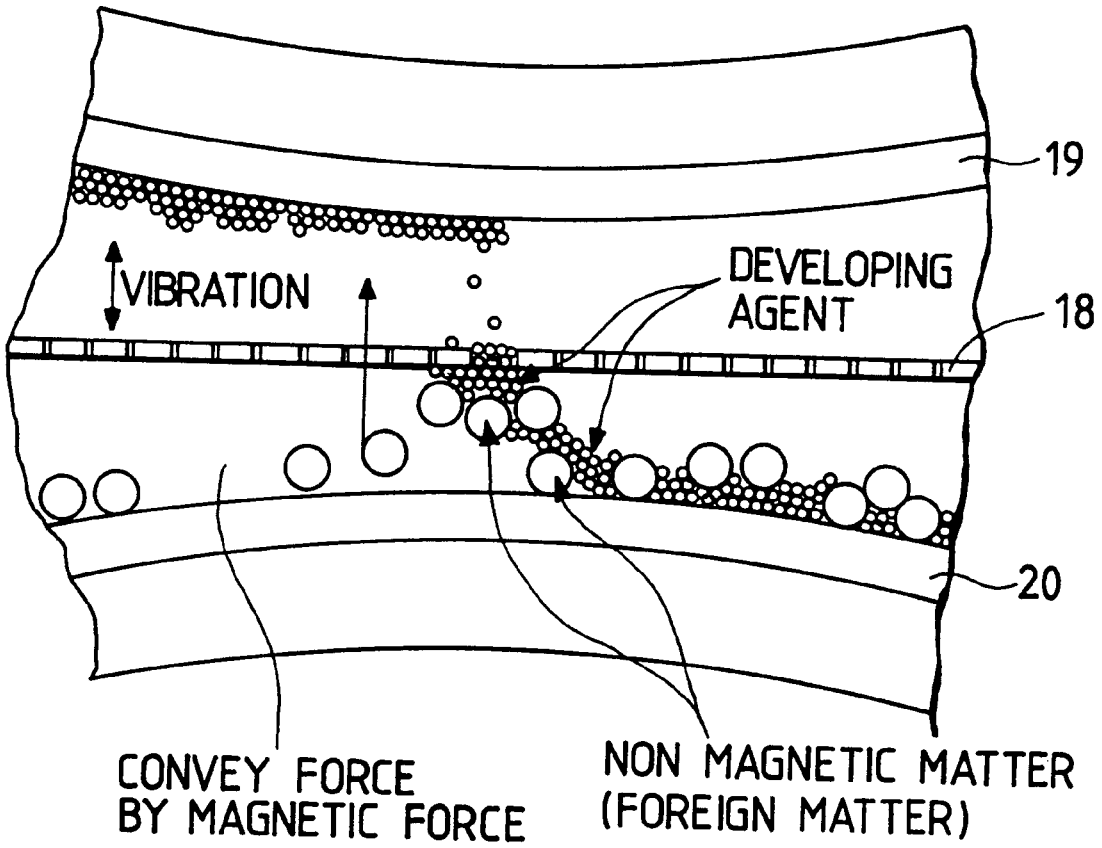
FIG. 4 is a partial view showing a condition that a developing agent is separated from non-magnetic matters (foreign matters) by the developing agent filtering apparatus.

Next, the filtering apparatus will be explained with reference to FIGS. 2 to 4. FIG. 2 is a sectional view of the filtering apparatus to which the present invention is applied, FIG. 3 is a side view of the filtering apparatus, and FIG. 4 is an explanatory view showing a condition that the magnetic toner is being separated from the non-magnetic matter (foreign matters) by the filtering apparatus.

The filtering apparatus 17 has a frame 17*a* within which a mesh filter 18 made of non-magnetic material (for example, non-magnetic stainless wires, non-magnetic brass wires or nylon fiber wires) is arranged in a position substantially perpendicular to a gravity acting direction (that is, a position having an inclination angle of zero degree ($\alpha$=0°) with respect to a horizontal plane). Non-magnetic sleeves 19, 20 having magnet rollers (magnetic field generating members) 19', 20' therein are arranged above and below the mesh filter, respectively. The sleeves 19, 20 are rotated in directions shown by the arrows in FIG. 2 in such a manner that magnetic poles $N_{19}$ and $S_{20}$ of the magnet rollers 19' and 20' are always opposed to each other. By the rotation of the sleeve 20, the residual matter adhered to the surface of the sleeve 20 is shifted to a direction same as the rotational direction of the sleeve 20, and, by the rotation of the sleeve 19, the magnetic toner adhered to the surface of the sleeve 19 is shifted to a direction same as the rotational direction of the sleeve 19.

Incidentally, the relation between the magnetic forces of the magnetic poles $N_{19}$ and $S_{20}$ in the separation portion (for separating the magnetic toner from the foreign matters) where the sleeves 19 and 20 are opposed to each other with the inter-position of the mesh filter 18 is selected to $N_{19}>S_{20}$. Further, the mesh filter 18 is held by a support member 21 to which a cam 23 connected to a drive motor 22 is contacted. Accordingly, the support member 21 is vibrated by the cam 23 which is rotated by a driving force of the drive motor 22, thereby transmitting the vibration to the mesh filter 18 held by the support member.

Furthermore, convey screws 24, 25 are provided for conveying the toner. The convey screw 24 serves to send the magnetic toner and foreign matter collected in the cleaning device 5 to the filtering apparatus 17, and the convey screw 25 serves to re-supply the reproduced magnetic toner to the developing device 2 (including the hopper portion 3). A doctor blade 26 serves to regulate a thickness of a layer of the adhered matter on the surface of the sleeve 20, and a scraper blade 27 serves to scrape the magnetic toner adhered to the surface of the sleeve 19. Incidentally, the reference numeral 28 denotes a non-magnetic abutment member for scraping the adhered matter (non-magnetic matter) from the surface of the sleeve 20 to a collection portion 29; and 30 denotes a seal member for preventing the minute particles such as toner particles from leaking out of the filtering apparatus.

Next, the separation operation (for separating the magnetic toner from the other foreign matter) effected by the filtering apparatus 17 will be explained. First of all, the magnetic toner and the other foreign matter collected from the photo-sensitive drum 1 by the cleaning device 5 are supplied toward the sleeve 20 of the filtering apparatus 17 by the convey screw 24. Then, the magnetic toner and the foreign matter are adhered to the surface of the sleeve 20 to be conveyed upwardly by the rotation of the sleeve 20. Although the foreign matter such as paper powder are non-magnetic, and since when they are collected from the photosensitive drum it is mixed with the magnetic toner, the foreign matter can be adhered to the surface of the sleeve 20 together with the magnetic toner. The thickness of the layer of the mixture of the magnetic toner and the foreign matter adhered to the sleeve 20 is regulated to a predetermined value by the doctor blade 26, and the mixture is sent to the separation portion where the sleeve 20 is opposed to the sleeve 19.

As mentioned above, since the relation between the magnetic forces of the magnetic poles $N_{19}$ and $S_{20}$ in the separation portion is selected such that $N_{19}>S_{20}$, the magnetic toner and the other foreign matter sent to the separation portion (where the sleeves 19, 20 are opposed to each other) by the sleeve 20 are ejected from the surface of the sleeve 20 toward the surface of the sleeve 19 by the magnetic field generated by the magnets 19', 20'.

In this case, since there is the mesh filter 18 between the sleeves 19, 20, only the magnetic toner having the small particle diameter can pass through the mesh filter 18 and the foreign matter such as the paper powder considerably greater than the toner cannot pass through the mesh filter 18.

As shown in FIG. 4, since the mesh of the filter 18 has openings (preferably, from 150 μm (#100) to 37.4 μm (#400)) greater than the particle diameter (average diameter of 5 to 20 μm) of the magnetic toner by several times, the magnetic toner can pass through the mesh smoothly. On the other hand, regarding foreign matter which could not pass through the mesh, since the magnetic toner is gradually decreased from the mixture (toner and foreign matter), the flying force of the foreign matter becomes smaller than the gravity force, with the result that the foreign matter is dropped on the surface of the sleeve 20 by its own weight.

Further, in the illustrated embodiment, even if the paper powder (foreign matter) particles are clogged in the mesh, since the vibration (preferably, having the frequency of 50 Hz or more and the amplitude of about 0.2 to 4.0 mm) is applied to the mesh filter 18 by the cam 23 connected to the drive motor 22, the foreign matter clogged in the mesh 18 is shaken down.

Further, since the weight of the magnetic toner itself is small, by setting the magnetic field so that the conveying force due to the magnetic force becomes sufficiently greater than the gravity force of the magnetic toner, it is possible to eject the magnetic toner upwardly.

In this way, according to the illustrated embodiment, since the magnetic toner is separated from the foreign matter by shifting the residual matter from a downstream side to an upstream side in the gravity force acting direction, the non-magnetic matter (foreign matter) separated from the magnetic toner cannot pass through the mesh filter 18 and is dropped onto the sleeve 20. Further, in the illustrated embodiment, since the non-magnetic matter is positively shaken down by the vibration applied to the mesh filter 18, it is possible to effectively separate the magnetic toner from the foreign matter and to prevent the clogging of the mesh 18 continuously.

Further, the magnetic toner separated and adhered to the sleeve 19 is conveyed downstream by the rotation of the sleeve 19, and then the magnetic toner is scraped from the surface of the sleeve 19 by the scraper blade 27 and is conveyed out of the reproducing apparatus 17 by the convey screw 25. The reproduced magnetic toner is sent to the developing device 2 (including the hopper portion 3) by a convey device (not shown) for the preparation for the developing operation.

The foreign matter scraped in the separation portion is dropped onto the sleeve 20 without ejecting toward the sleeve 19. The dropped foreign matter is further conveyed together with the residual magnetic toner remaining on the sleeve 20, and these matters are once removed from the surface of the sleeve 20 by the non-magnetic abutment member 28 abutted against the sleeve 20. Since the non-magnetic abutment member 28 is abutted against the sleeve 20 with a weak abutment pressure, the foreign matter adhered to the sleeve 20 with a weak force can be scraped by the abutment member, but the lump of the magnetic toner not separated in the separation portion and remaining on the sleeve 20 cannot be scraped by the non-magnetic abutment member 28 since the lump is strongly adhered to the sleeve 20 with a strong force. Thus, the lump is conveyed downstream to try to be separated again. By repeating a series of the above-mentioned processes, the lump of the magnetic toner is gradually reduced, and is ejected toward the sleeve 19. Accordingly, substantially no magnetic toner is collected to the collection portion 29, and, thus, the major part of the matter collected in the collection portion is non-magnetic foreign matter.

As mentioned above, by destroying the lump of the magnetic toner and by shaking down the foreign matter adhered to the mesh filter 18 in the gravity acting direction, it is possible to prevent the clogging of the mesh and to separate the magnetic toner from the foreign matter continuously and effectively.

Further, in the reproducing apparatus according to the present invention, in order to prevent the clogging of the mesh 18 when the apparatus is in an inoperative condition or when the electric power is not being supplied to the reproducing apparatus by turning OFF a main switch, the relative position between the magnetic poles of the magnets 19', 20' of the sleeves 19, 20 which are opposed to each other with the interposition of the mesh filter 18 can be displaced. Such displacement mechanism will now be explained with reference to FIGS. 5 and 6.

Shaft ends 19*a*, 20*a* of the magnets rotatably supported within the sleeves 19, 20 are protruded outwardly from a frame 17*a* of the reproducing apparatus 17, and such shaft ends 19*a*, 20*a* each has a semi-circular cross-section. One ends of pole positioning plates 31, 32 are fitted on the semi-circular shaft ends 19*a*, 20*a*, respectively. The other end of the pole positioning plate 31 is secured to the frame 17*a* by a screw. When the reproducing apparatus is being operated to separate the magnetic toner from the paper powder (foreign matter), the positions of the magnetic poles of the magnet contained in the sleeve 19 are fixed at positions shown in FIG. 2. Further, a shaft 33 is fitted in the other end of the pole positioning plate 32 fitted on the shaft end 20*a* of the magnet 20' and is received in a slot 35 formed in an end portion of a lever 34. The lever 34 has a rotational fulcrum 36 secured to the frame 17*a*, and the other end of the lever is connected to an iron core 39 of a solenoid 38 via a pin 37.

Further, in the proximity of the slot 35, one end of a tension spring 40 is connected to one end of the lever 34, and the other end of the tension spring 40 is connected to a bent portion 42 of a solenoid support 41. With this arrangement, the magnet contained in the sleeve 20 is biased in an anti-clockwise direction by a restoring force of the tension spring 40. Further, the position (i.e., the magnetic pole positions) of the magnet of the sleeve 20 so biased is regulated and fixed by abutting the lever 34 against a bent portion 43 of the solenoid support 41. Incidentally, the sleeves 19, 20 are rotated by a drive source (not shown) via gears.

Accordingly, in the developing agent filtering apparatus according to the illustrated embodiment, not only in the copying operation but also the other conditions, the magnet 19' is always fixed in the predetermined orientation. That is to say, as shown in FIG. 2, N-magnetic pole is always opposed to the mesh filter 18.

Figure 5:
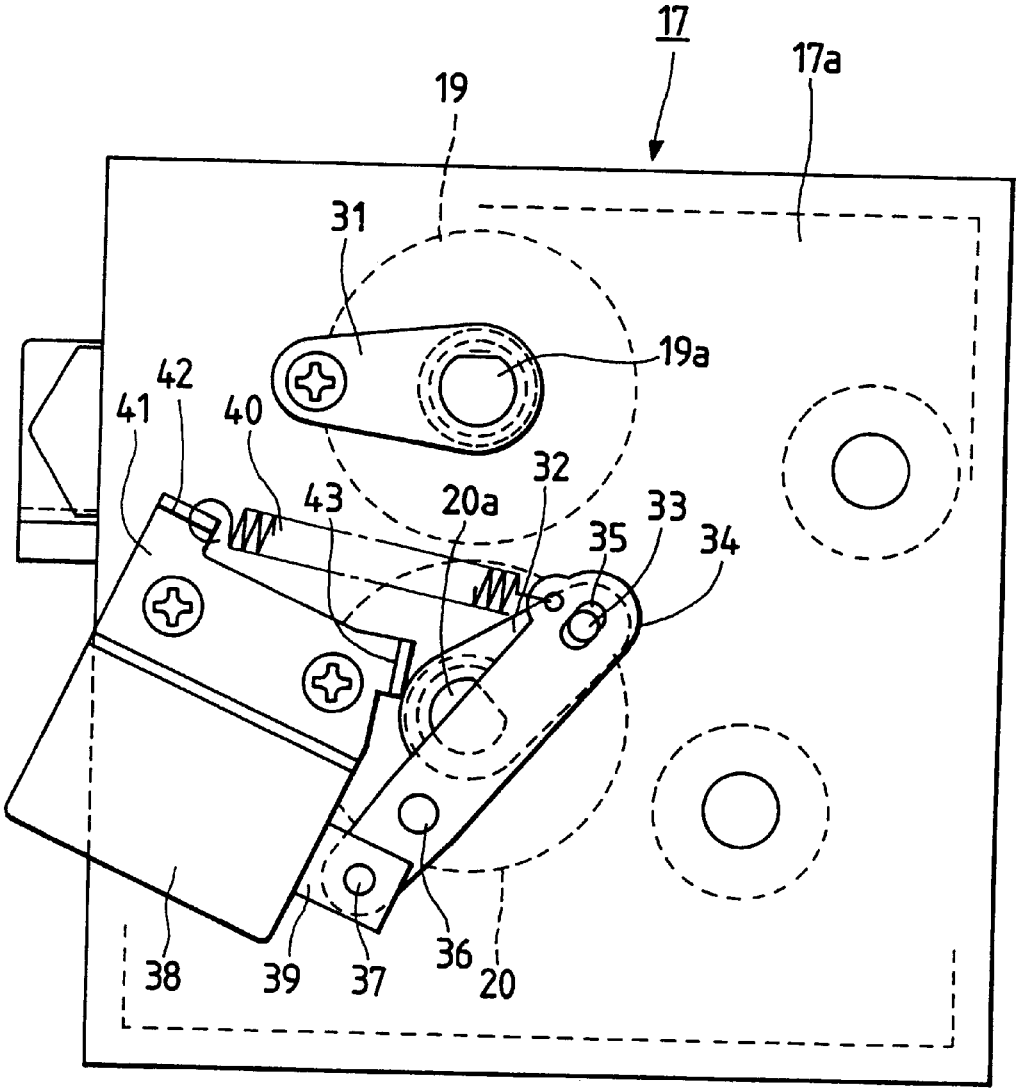
FIGS. 5 and 6 are explanatory views showing a displacement mechanism for displacing magnetic poles in the developing agent filtering apparatus according to the first embodiment.

On the other hand, the position of the magnetic pole (to be opposed to the mesh filter 18) of the magnet 20' during the copying operation is different from the position of the magnetic pole of this magnet in the other conditions. That is to say, during the copying operation, as shown in FIG. 5, by retracting the iron core 39 by energizing the solenoid 38, the magnetic pole positions of the magnet contained in the sleeve 20 are fixed to the developing agent reproduction permitting position as shown in FIG. 2. Here, the solenoid 38 is adjustably mounted on the solenoid support 41 to optimize the magnetic pole positions of the magnet 20' upon the retraction of the iron core 39.

Figure 6:
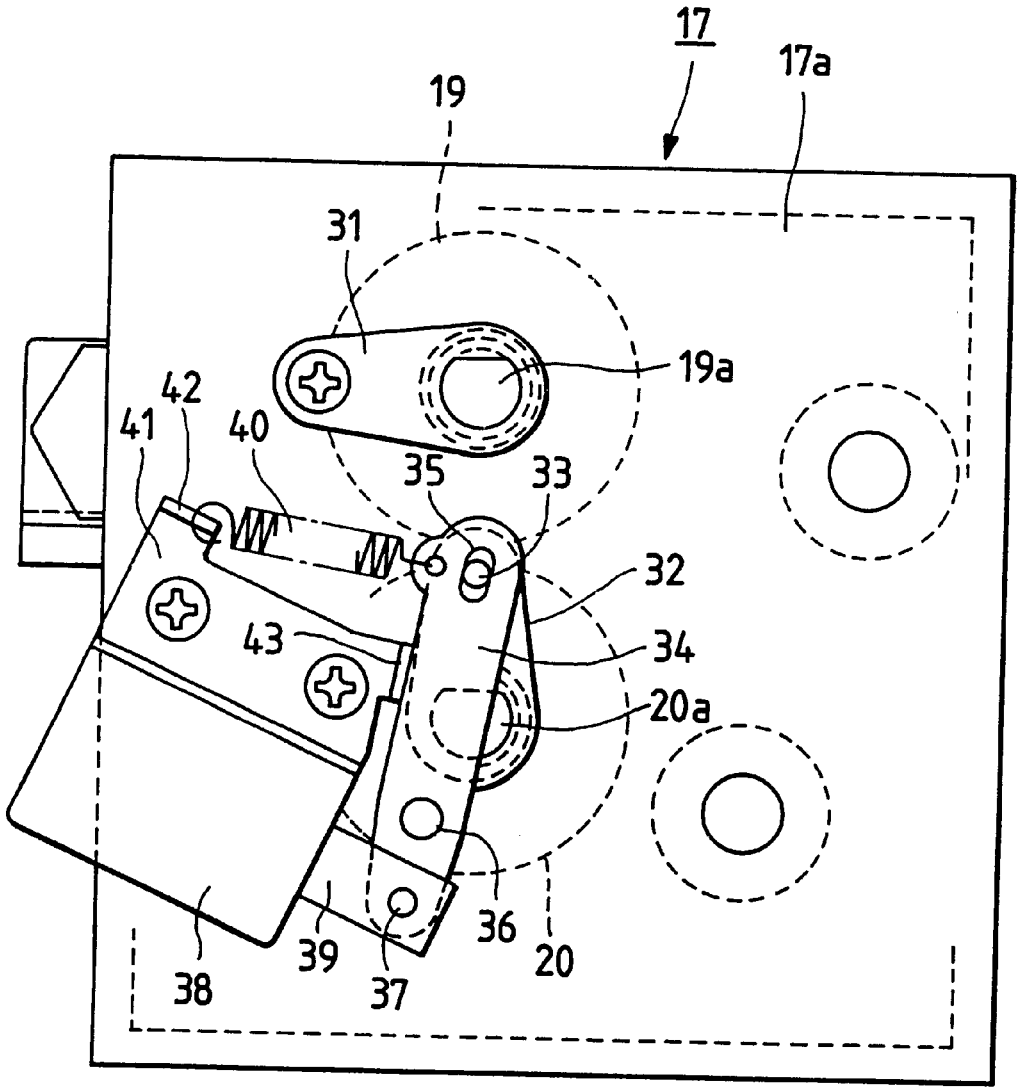

When the copying operation is finished, as shown in FIG. 6, the solenoid 38 is deenergized, with the result that the lever 34 is rotated in the anti-clockwise direction by the restoring force of the tension spring 40 and the pole positioning plate 32 is also rotated in the same direction to abut the lever 34 against the bent portion 43 of the solenoid support 41, thereby opposing the magnetic pole $N_{20}$ of the magnet 20' to the magnetic pole $N_{19}$ of the magnet 19' of the sleeve 19. In this condition, the magnetic pole positions of the magnet 20' are fixed. That is to say, other than the copying operation, since the magnetic poles $N_{20}$ and $N_{19}$ are opposed to each other with the interposition of the mesh filter 18, the magnetic toner cannot fly from the magnetic pole $N_{20}$ toward the magnetic pole $N_{19}$.

With the above-mentioned arrangement and operation, it is possible to prevent the magnetic toner from solidifying in the proximity of the separation portion (where the sleeves 19, 20 are opposed to each other) both in the inoperative condition and in the main switch OFF condition.

Incidentally, in the illustrated embodiment, while an example that in the inoperative condition the magnetic poles of the pair of magnetic field generating members which are opposed to each other have the same polarity was explained, the present invention is not limited to this example, but the magnetic pole $N_{19}$ of the magnet 19' may be opposed to a central portion between the magnetic poles $S_{20}$ and $N_{20}$ of the magnet 20'. However, when the magnetic pole $N_{19}$ is opposed to the magnetic pole $N_{20}$, it is more effective to prevent the clogging of the mesh. After all, the magnetic field may be generated so that the triboelectric brush of the magnetic toner (including the non-magnetic foreign matter in this point) is not formed between the pair of magnetic field generating members when the filtering apparatus is in the inoperative condition.

Further, in the illustrated embodiment, while the rotational direction of the magnet upon de-energization of the solenoid 38 was the same as the rotational direction of the sleeve 20, such rotational direction of the magnet may be set to be opposite to the rotational direction of the sleeve 20. In this case, since the foreign matter (such as the paper powder) other than the magnetic toner entered between the doctor blade 26 and the sleeve 20 is discharged from the space between the sleeve 20 and the blade 26, it is possible to avoid the inconvenience that the force for conveying the magnetic toner toward the mesh filter 18 is weakened by the local change in the thickness of the toner layer on the sleeve 20 due to the formation of the lump of the magnetic toner between the sleeve 20 and the blade 26.

Figure 7:
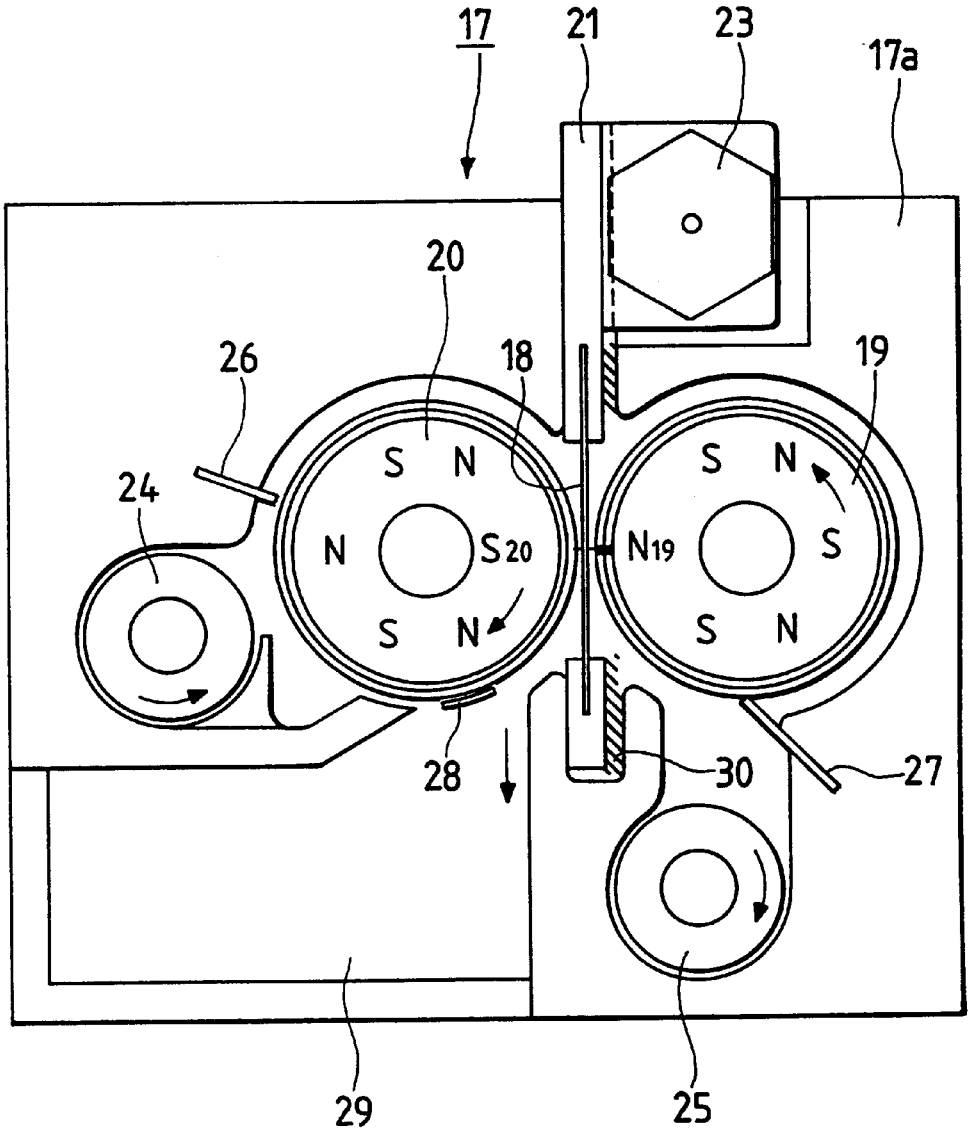
FIG. 7 is a sectional view showing an alteration of the developing agent filtering apparatus according to the first embodiment.

Further, in the illustrated embodiment, in lieu of the magnet 20' contained in the sleeve 20, the magnet 19' contained in the sleeve 19 may be rotatable. In addition, as shown in FIG. 7, the present invention can be applied to a filtering apparatus wherein a mesh filter 18 is arranged vertically and sleeves 19, 20 having magnets (magnetic field generating means) arranged on both sides of the mesh filter in an opposed relation.

Figure 8:
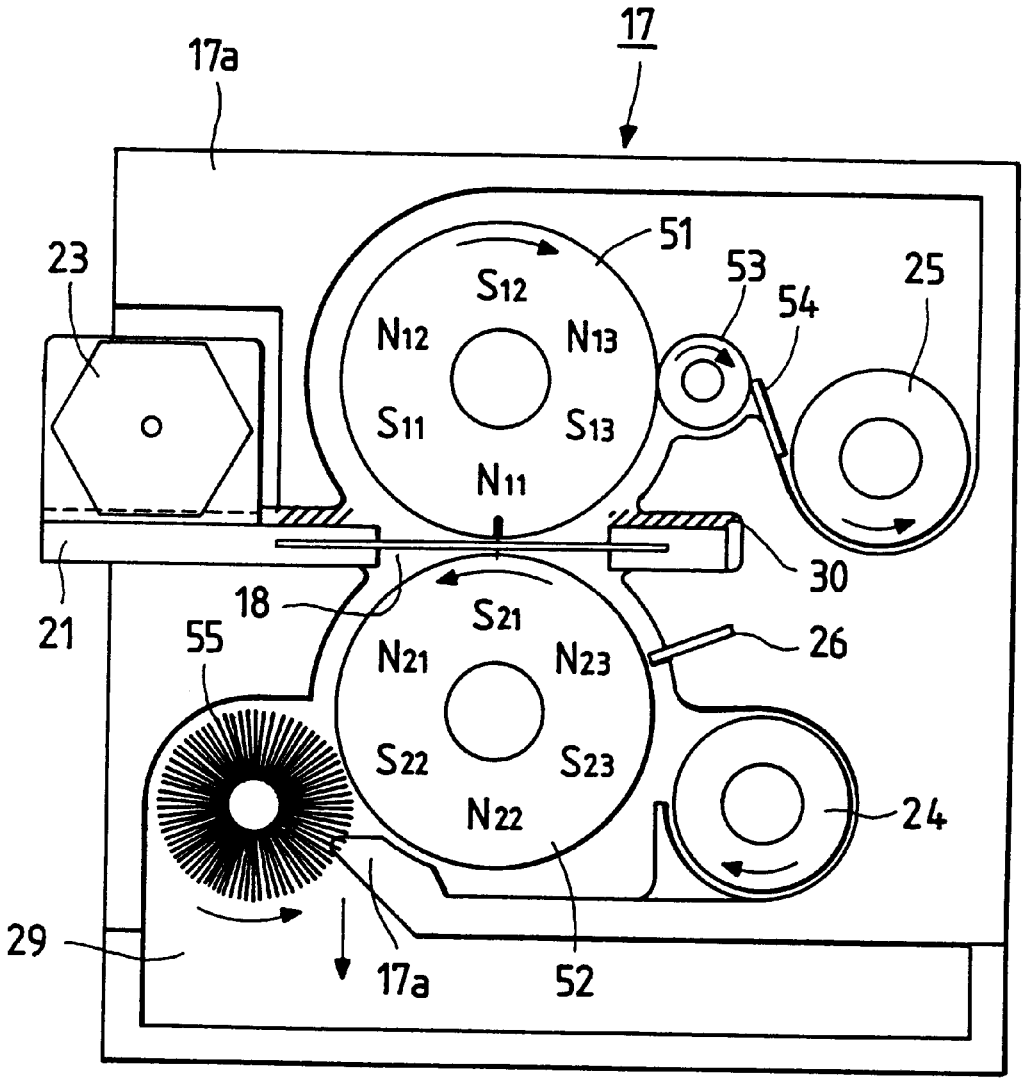
FIG. 8 is a sectional view of a developing agent filtering apparatus according to a second embodiment of the present invention.

Next, a second embodiment of the present invention will be explained with reference to FIG. 8. FIG. 8 is a sectional view showing the second embodiment. Incidentally, the constructural elements having the function equivalent to those of the elements described in connection with the former embodiment are designated by the same reference numerals.

In FIG. 8, magnet rollers (magnetic force generating means) 51, 52 are arranged in the separation portion in such a manner that the opposite magnetic poles are opposed to each other. The relation of the magnetic forces between the magnetic poles ($N_{11}$, $S_{11}$) of the magnet roller 51 and the magnetic poles ($N_{21}$, $S_{21}$) of the magnet roller 52 is selected such that $N_{11}>S_{21}$ and $S_{11}>N_{21}$. Further, the magnetic poles are arranged with a predetermined angular interval so that the opposite magnetic poles are always opposed to each other in the separation portion when the magnet rollers are rotated at the same speed by a drive source which will be described later.

Next, the operation of the filtering apparatus according to this embodiment will be explained. The developing agent (magnetic toner) on the magnet roller 52 is sent to the separation portion while regulating a thickness of a toner layer by a doctor blade 26. In the separation portion, the magnetic toner is effectively attracted by concentrated lines of magnetic force generated by the opposite magnetic poles. In this case, as mentioned above, since the relation of the magnetic forces between the magnetic poles in the separation portion is selected so that the magnetic forces of the magnetic poles $N_{11}$, $S_{11}$ of the upper magnet roller 51 become greater than those of the magnetic poles $N_{21}$, $S_{21}$ of the lower magnet roller 52, the magnetic toner is attracted toward the magnetic poles $N_{11}$, $S_{11}$ to shift upwardly through the mesh filter 18. In this way, the magnetic toner is separated from the other foreign matter by the mesh filter 18.

Further, a scraper roller 53 is rotatably abutted against the magnet roller 51 so that the separated magnetic toner on the magnet roller 51 is once attracted to the scraper roller 53. Then, the magnetic toner is scraped from the scraper roller by a scraper blade 54 abutted against the scraper roller 53. The magnetic toner separated from the foreign matter is sent out of filtering apparatus 17 by a convey screw 25. Further, the residual foreign matter is conveyed downstreamly together with the residual magnetic toner by the magnet roller 52, and the foreign matter is collected by a non-magnetic cleaning brush 55 and then is scraped by a protruded portion 17*a* to be dropped into a collection portion 29. In this case, since the toner is magnetic, the toner remains on the magnet roller 52 without being collected by the cleaning brush 55 and is conveyed downstream to tray to be separated again. Thus, substantially no magnetic toner is collected in the collection portion, and the major part of the matter collected in the collection portion 29 is non-magnetic foreign matter.

Figure 9:
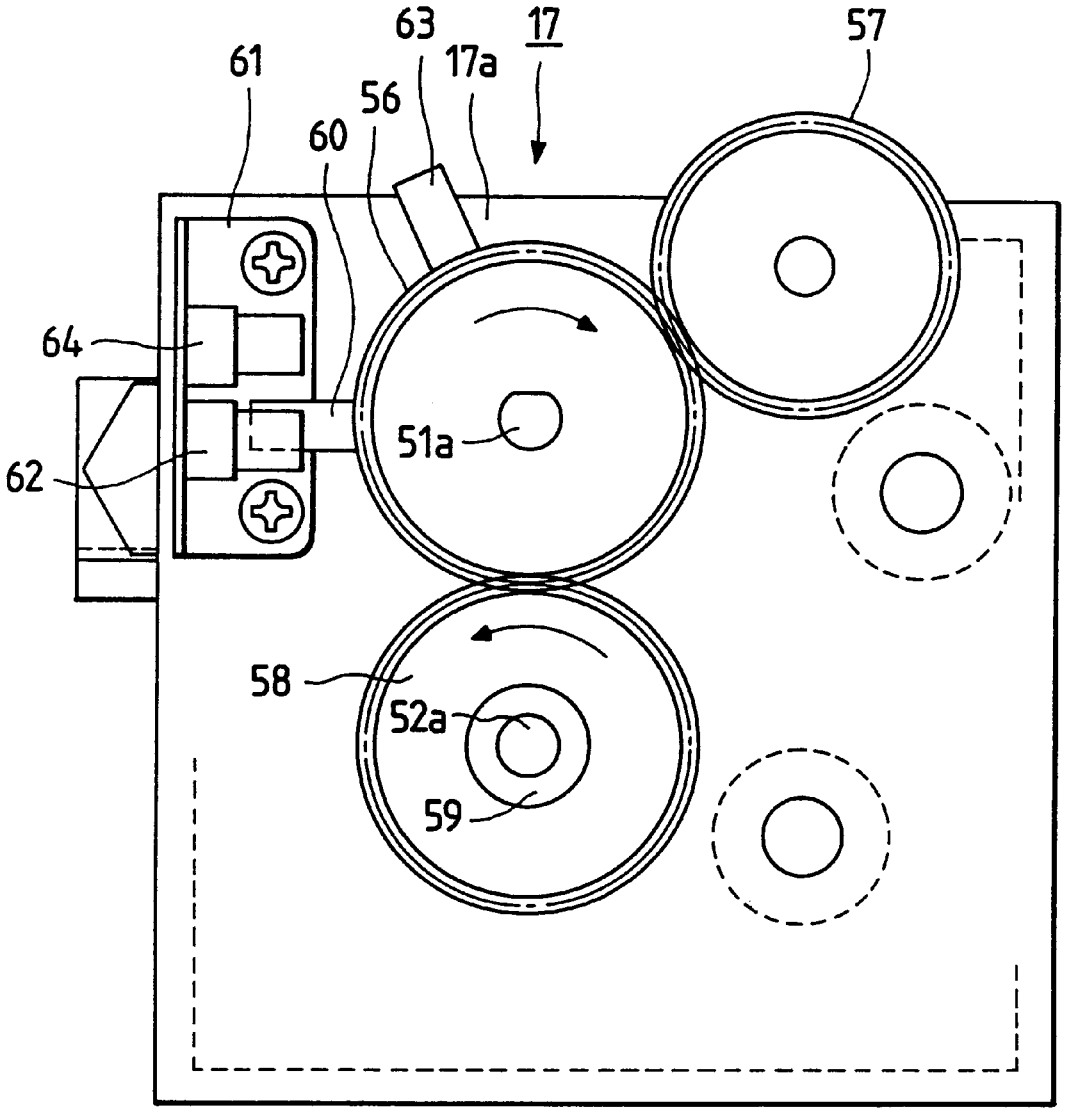
FIGS. 9 and 10 are explanatory views showing a displacement mechanism for displacing magnetic poles in the developing agent filtering apparatus according to the second embodiment.
Figure 10:
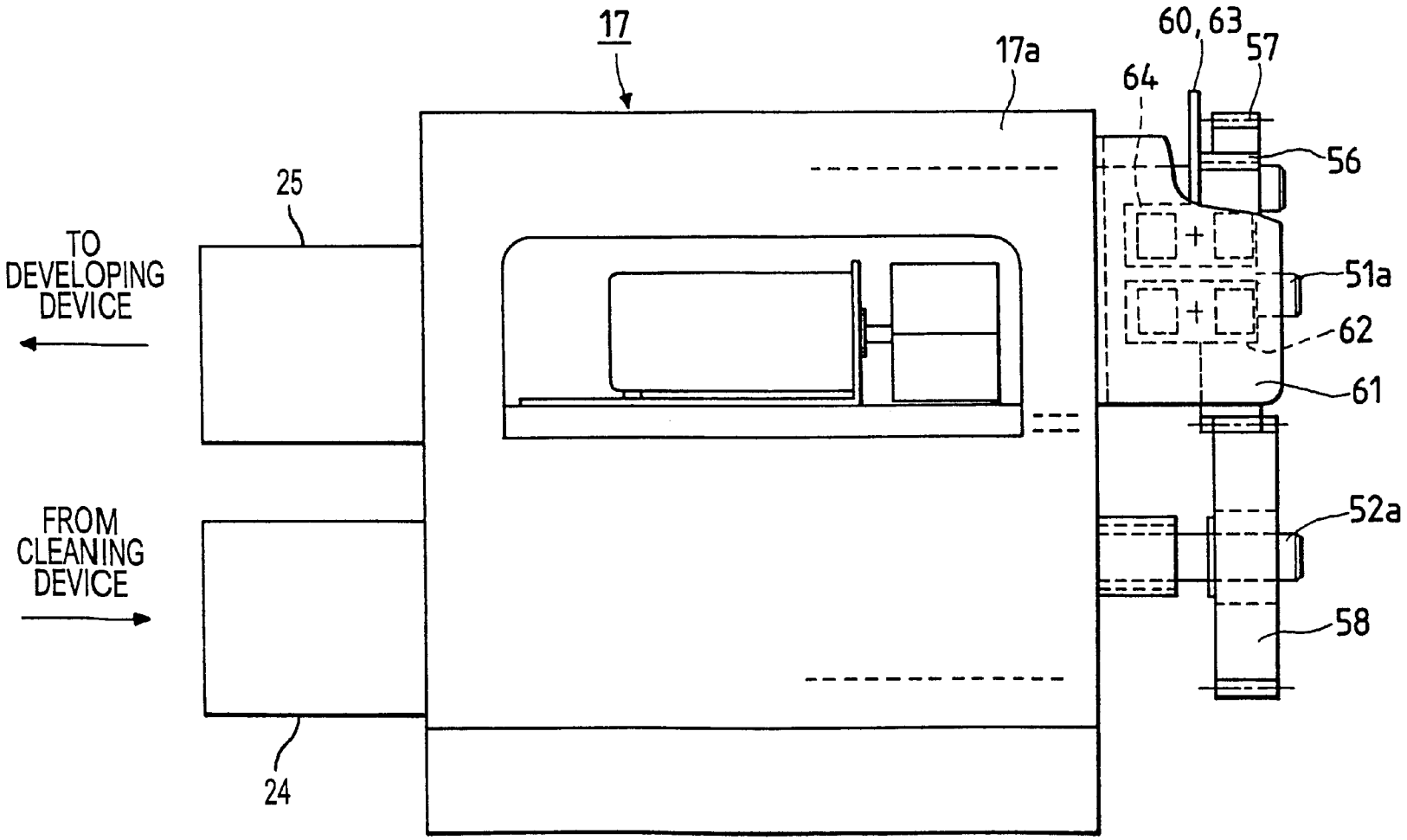
Figure 11:
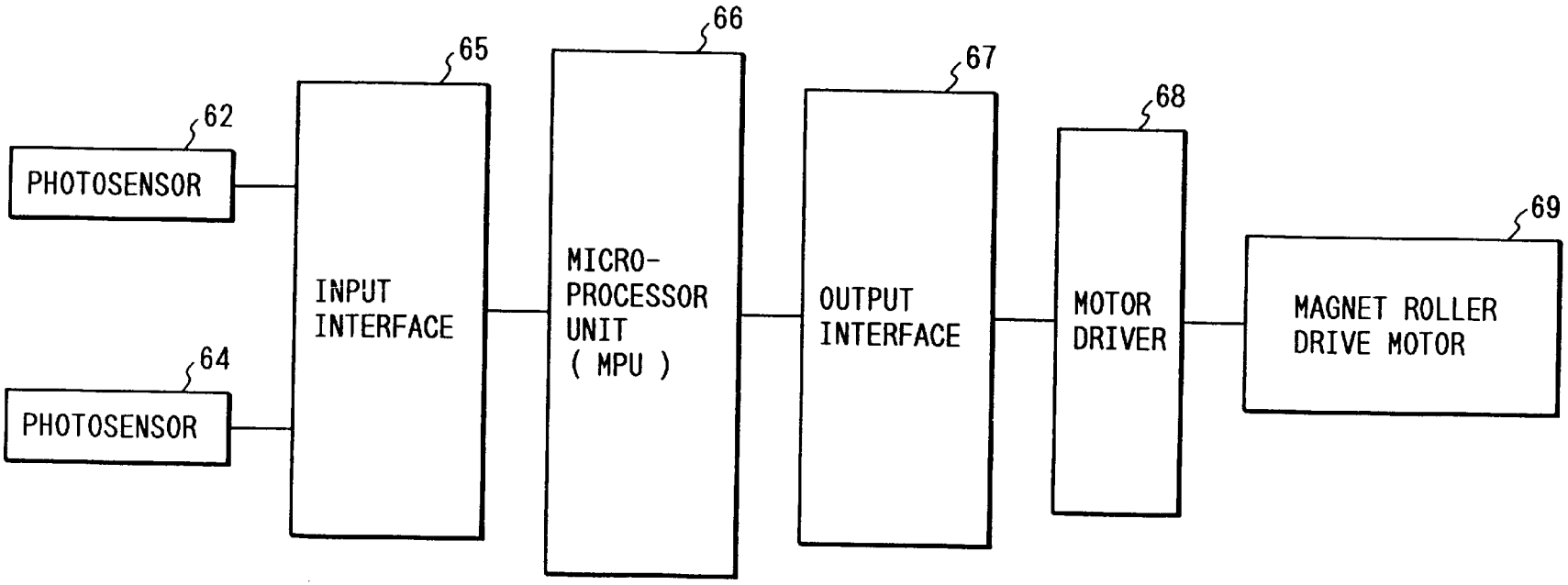
FIG. 11 is a block diagram showing a control system for the developing agent reproducing apparatus.

Further, in the filtering apparatus, in order to prevent the clogging of the mesh 18 when the copying operation is stopped or when the apparatus is in an inoperative condition, the relative position between the magnetic poles of the magnet rollers 51, 52 opposed to each other with the interposition of the mesh filter 18 can be displaced. Such displacement mechanism will now be explained with reference to FIGS. 9 to 11. FIGS. 9 and 10 are explanatory views showing the displacement mechanism for displacing the relative position of the magnetic poles in the filtering apparatus, and FIG. 11 is a block diagram showing a control system for the filtering apparatus.

A gear 56 is attached to a shaft end 51*a* of the magnet roller 51 protruded outwardly from a frame 17*a* of the filtering apparatus 17, and a driving force is transmitted from a drive source (not shown) to the gear 56 via a gear 57 rotatably supported by the frame 17*a*. Further, a gear 58 meshed with the gear 56 is attached to a shaft end 52*a* of the magnet roller 52, and a one-way clutch 59 for regulating a rotational direction is provided between the shaft end 52*a* of the magnet roller 52 and the gear 58. The magnet roller 52 cooperates with the gear 58 to rotate in a direction shown by the arrow only when the gear 58 is rotated in a direction shown by the arrow by the action of the one-way clutch 59 during the operation of the filtering apparatus. The number of teeth of the gear 56 is the same as the number of teeth of the gear 58 to rotate the magnet rollers 51, 52 in phase with each other so that the opposite magnetic poles are always opposed to each other in the separation portion. In the initial assembling of the magnet rollers 51, 52 and the gears 56, 58 and in the disassembling and reassembling of the same for the maintenance, the initial phase alignment between the magnetic poles can be facilitated by providing marks on the magnet rollers 51, 52.

In the normal operation, the magnet rollers 51, 52 are rotated in directions shown by the arrows to separate the foreign matter such as the paper powder from the collected developer. When the copying operation is finished, the magnet rollers 51, 52 continue to rotate in the directions shown by the arrows by the driving force transmitted to the roller shafts. However, when a flag 60 secured to a side surface of the drive gear 56 of the magnet roller 51 passes across a photo-sensor 62 arranged on a support plate 61 secured to the frame 17*a* of the filtering apparatus 17, the magnet rollers 51, 52 are stopped by a signal from the photo-sensor 62, so that the magnetic pole $N_{11}$ is opposed to the magnetic pole $S_{21}$ in the separation portion (FIG. 8).

Thereafter, the magnet rollers 51, 52 are rotated in directions opposite to the directions shown by the arrows by the drive source (not shown) when the drive source receives the command from a micro-processor unit (MPU) for controlling the apparatus. When a flag 63 secured to the side surface of the gear 56 passes across a photo-sensor 64 arranged on the support plate 61, the magnet rollers 51, 52 are stopped by a signal from the photo-sensor 64.

In the above operation, since the one-way clutch 59 acting as mentioned above is provided between the magnet roller 52 and the gear 58, and while the gear 58 is being rotated in the direction opposite to the direction shown by the arrow, the magnet roller 52 is not rotated. Thus, when the flag 63 eventually passes across the photo-sensor 64, the magnet rollers 51, 52 are stopped so that the magnetic pole $S_{11}$ of the magnet roller 51 is opposed to the magnetic pole $S_{21}$ of the magnet roller 52 in the separation portion.

As shown in the block diagram of FIG. 11, the control system for the filtering apparatus is designed so that the signals from the photo-sensors 62, 64 are sent to the micro-processor unit (MPU) 66 through an input interface 65 and a motor driver 68 is driven via an output interface 67 on the basis of such signals, thereby driving a drive motor 69 for driving the magnet rollers.

In the filtering apparatus according to the illustrated embodiment, when the same polarity of magnetic poles of the magnet rollers 51, 52 are opposed to each other in the separation portion, the magnet rollers 51, 52 are apt to be rotated by the repelling force, thereby deviating the opposite magnetic poles from each other. In order to avoid this, a minute current corresponding to the repelling force may be applied to the motor (drive source) to prevent such undesirable rotations of the magnet rollers. Further, it should be noted that, in place of the above construction of the filtering apparatus, the driving force may be transmitted to the magnet roller 52 and a one-way clutch 59 may be arranged between the magnet roller 51 and the gear 56.

While the present invention was explained in connection with specific embodiments, the present invention is not limited to such embodiments, but various alterations and modifications can be made within the scope of the present invention.

What is claimed is:

1. A developing agent filtering apparatus comprising:

filtering means for filtering magnetic toner from a mixture of a magnetic toner and foreign matter, said filtering means including a pair of magnetic field generating members, and a filter for regulating a shifting movement of the foreign matter from one of said pair of magnetic field generating members to the other; and switching means for changing a configuration of a magnetic field generated by said pair of magnetic field generating members, said switching means switching a relative position between said pair of magnetic field generating members between a first position where opposite magnetic polarities of said pair of magnetic field generating members are opposed to each other, and a second position different from the first position.

2. A developing agent filtering apparatus according to claim 1, wherein said filter comprises a mesh.

3. A developing agent filtering apparatus according to claim 1, wherein said magnetic field generating members comprises magnet rollers.

4. A developing agent filtering apparatus according to claim 3, wherein said filtering means further comprises rotatable sleeves arranged around said magnet rollers.

5. A developing agent filtering apparatus according to claim 1, wherein the opposite magnetic polarities of said pair of magnetic field generating members are opposed to each other when the magnetic toner is filtered, and the same magnetic polarities of said pair of magnetic field generating members are opposed to each other when the magnetic toner is not filtered.

6. A developing agent filtering apparatus according to claim 4, wherein said filtering means further comprises a first sleeve for bearing the mixture thereon, and a second sleeve for bearing the magnetic toner ejected from a surface of said first sleeve, and wherein said filter is arranged at an upstream side of said first sleeve and at a downstream side of said second sleeve in a gravity acting direction.

7. A developing agent filtering apparatus according to claim 6, wherein said first and second sleeves are rotated when the opposite magnetic polarities of said pair of magnet rollers are opposed to each other, and are stopped when the same magnetic polarities of said pair of magnet rollers are opposed to each other.

8. A developing agent filtering apparatus according to claim 6, wherein said switching means comprises a solenoid for driving at least one of said pair of magnet rollers, and wherein the opposite magnetic polarities of said pair of magnet rollers are opposed to each other when said solenoid is energized and the same magnetic polarities of said pair of magnet rollers are opposed to each other when said solenoid is de-energized.

9. A developing agent filtering apparatus according to claim 1, wherein said second position is a position where same magnetic polarities of said pair of magnetic field generating members are opposed to each other.

10. An image forming apparatus for forming a toner image on a recording material, said image forming apparatus comprising:

an image bearing member;

image forming means for forming a toner image on said image forming means, said image forming means including a developing portion for supplying magnetic toner to said image bearing member;

cleaning means for removing residual matter remaining on said image bearing member after the toner image was transferred to a recording material, from said image bearing member;

filtering means for filtering magnetic toner from the residual matter removed from said image bearing member, said filtering means including a pair of magnetic field generating members, and a filter for regulating a shifting movement of foreign matter other than the magnetic toner from one of said pair of magnetic field generating members to the other; and a switching means for changing the configuration of a magnetic field generated by said pair of magnetic field generating members, said switching means switching a relative position between said pair of magnetic field generating members between a first position where opposite magnetic polarities of said pair of magnetic field generating members are opposed to each other and a second position different from said first position.

11. An image forming apparatus according to claim 10, wherein said filter comprises a mesh.

12. An image forming apparatus according to claim 10, wherein said magnetic field generating members comprises magnet rollers.

13. An image forming apparatus according to claim 12, wherein said filtering means further comprises rotatable sleeves arranged around said magnet rollers.

14. An image forming apparatus according to claim 10, wherein the opposite magnetic polarities of said pair of magnetic field generating members are opposed to each other when the magnetic toner is filtered, and the same magnetic polarities of said pair of magnetic field generating members are opposed to each other when the magnetic toner is not filtered.

15. An image forming apparatus according to claim 13, wherein said filtering means further comprises a first sleeve for bearing the mixture thereon, and a second sleeve for bearing the magnetic toner ejected from a surface of said first sleeve, and wherein said filter is arranged at an upstream side of said first sleeve and at a downstream side of said second sleeve in a gravity acting direction.

16. An image forming apparatus according to claim 15, wherein said first and second sleeves are rotated when the opposite magnetic polarities of said pair of magnet rollers are opposed to each other, and are stopped when the same magnetic poles of said pair of magnet rollers are opposed to each other.

17. An image forming apparatus according to claim 15, wherein said switching means comprises a solenoid for driving at least one of said pair of magnet rollers, and wherein the opposite magnetic polarities of said pair of magnet rollers are opposed to each other when said solenoid is energized and the same magnetic polarities of said pair of magnet rollers are opposed to each other when said solenoid is disenergized.

18. An image forming apparatus according to claim 10, further comprising convey means for conveying the magnetic toner filtered by said filtering means to said developing portion.

19. An image forming apparatus according to claim 10, wherein said second position is a position where same magnetic polarities of said pair of magnetic field generating members are opposed to each other.

* * * * *